United States Patent [19]

Otto

[11] 4,380,870

[45] Apr. 26, 1983

[54] VACUUM HAIR CUTTING DEVICE

[75] Inventor: Gary D. Otto, Tahlequah, Okla.

[73] Assignee: Feather Quick Companies, Inc., Tahlequah, Okla.

[21] Appl. No.: 295,668

[22] Filed: Aug. 24, 1981

[51] Int. Cl.[3] ..... B26B 19/44

[52] U.S. Cl. ..... 30/133

[58] Field of Search ..... 30/133, 131, 201

[56] References Cited

U.S. PATENT DOCUMENTS

| | | | |
|---|---|---|---|
| 2,523,201 | 9/1950 | Ellis | 30/131 |
| 3,015,336 | 1/1962 | Caples | 30/133 X |
| 4,000,562 | 1/1977 | Alevras | 30/133 |
| 4,005,526 | 2/1977 | Clay | 30/133 |

*Primary Examiner*—Jimmy C. Peters

*Attorney, Agent, or Firm*—William S. Dorman

[57] ABSTRACT

An improved hair cutting apparatus used in conjunction with a vacuum suction source comprising a hollow cylindrical main housing connected at its upper end to a vacuum hose, a scissor support extending outwardly from the main housing for securing a pair of scissors in a transversely oriented position, an annular guide extending from the main housing opposite from the scissor support for supporting the cutting tips of the scissors, and a disc having a slot therein mounted in the main housing with the slot being disposed beneath and parallel to the scissors; and whereby, upon placing the main housing against a head and activating the vacuum suction source, a portion of hair is drawn into the main housing and through the slot to be cut by the scissors.

4 Claims, 5 Drawing Figures

VACUUM HAIR CUTTING DEVICE

BACKGROUND OF THE INVENTION

1. Field of the Invention

The present invention relates to an improved apparatus for precision hair cutting which employs a vacuum suction force. More particularly, the present invention relates to an apparatus which securely holds a pair of scissors in a position parallel to the head in the area to be cut and at a predetermined distance away from the head.

2. Prior Art

The art of haircutting is well known. It is generally accepted that it requires training and skill in order to provide a individual with a precision hair cut wherein all the hairs on the head are the same length from the scalp. A prior art Patent, U.S. Pat. No. 4,000,562 to Alevras, provides a means for the average individual to give a uniform haircut. The Alevras patent employs vacuum action to pull the hair into a elongated tube having a pair of cutting slots along its length. The tips of a pair of scissors are inserted into one of the slots in order to cut the hair. However, the scissors must be held in exactly the same position and angle each time in order to deliver a precision hair cut. The choice of hair length is limited by the number of cutting slots in the Alevras device, and is generally not desirable for the longer hair styles.

SUMMARY OF THE INVENTION

The present invention provides a device for precision hair cutting which employs vacuum suction to draw the hair into the device. The present invention does not require any particular skill or training and therefore can be used by the average individual. The present invention is provided with a means to securely hold the scissors in a position parallel to the head and at a predetermined distance from the head. The present invention also includes a tube attachment which can be of variable length to allow a large range of hair length choices.

The present invention comprises a hollow cylindrical main housing which is threaded at its upper end to receive a vacuum hose. The main housing includes an oval rubber scissor support which is slotted in order to receive the cutting portion of a pair of scissors. The rubber support is inserted into a support housing which extends outwardly from one side of the main housing. An annular scissor guide extends outwardly from a side of the main housing opposite from the support housing. The tips of the scissors are received in the scissors guide to move freely therein. The guide provides additional support and stability for the scissors.

The present invention also includes a cylindrical attachment or tube whose length can vary and which is inserted into the lower end of the main housing. The attachment is open at its lower end and is provided with a disc having a cut-out slot at its upper end. The cut-out slot lies underneath and parallel to the scissors.

The present invention is placed against the head and hair is drawn up through the open bottom end of the attachment by means of a vacuum source. The operator then cuts the hair with the scissors. The device of the present invention is moved systematically over the entire head until a uniform cut is achieved.

DETAILED DESCRIPTION OF THE PREFERRED EMBODIMENTS

Figure 1:
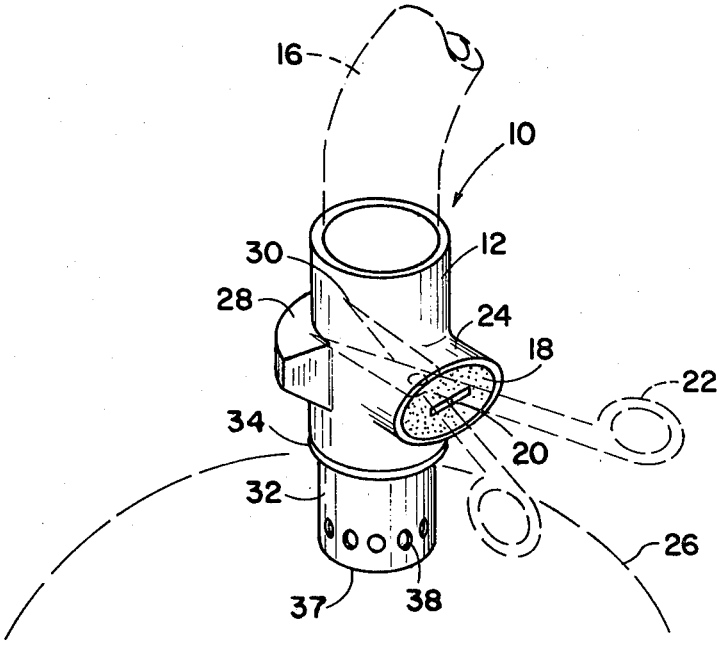
FIG. 1 is a perspective view of the hair cutting device of the present invention, being shown during use.

Referring to all of the drawings in detail, the present invention provides a precision hair-cutting device or apparatus 10 which is used in conjunction with a vacuum suction source (not shown). The device 10 of the present invention comprises a hollow (vertical) cylindrical tube or main housing 12 having a main cylindrical passageway 13 therethrough and which is threaded at its upper end 14 to receive a vacuum tube 16 (shown in dotted lines) and which is supported (or disposed), in a manner later to be described, over the head 26 of a person whose hair is to be cut. The main housing 12 is provided with an oval rubber support or gasket 18 having a lateral slot 20. The forward or cutting portion of a pair of scissors 22 (shown in dotted lines) is received in slot 20. Rubber support 18 is inserted into an oval shaped support housing 24 which extends outwardly from one side of main housing 12. The rubber support 18 and its associated support housing 24 provide a means whereby the scissors are held securely in a transversely oriented position with respect to the main passageway of the housing 12. The above supports allow the scissors to always cut in plane parallel to the area of the head 26 and at a predetermined distance away from the head.

An annular or arcuate scissor guide 28 extends outwardly from the side opposite from the support housing 24 for about half the circumference of main housing 12. The tips 30 of scissors 22 are received in scissor guide 28 and move freely therein. Guide 28 provides stability and additional support for the scissors 22.

Figure 4:
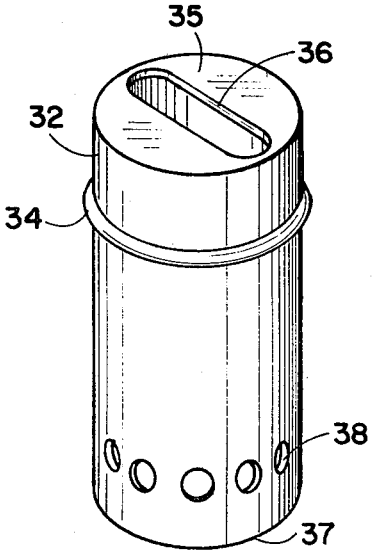
FIG. 4 is a perspective view of one of the attachments of the present invention.
Figure 5:
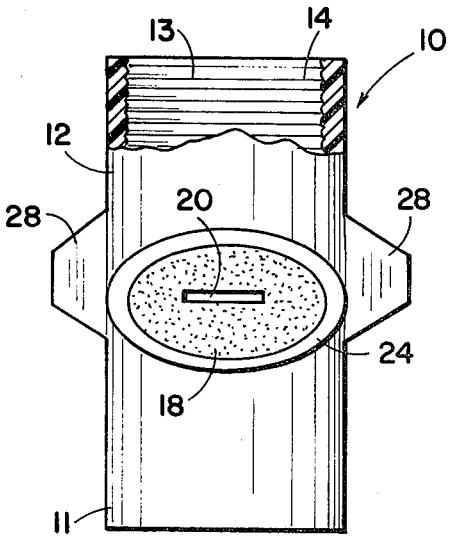
FIG. 5 is a side elevational view of the main housing of the device with a portion being cut away to show hidden detail.
Figure 3:
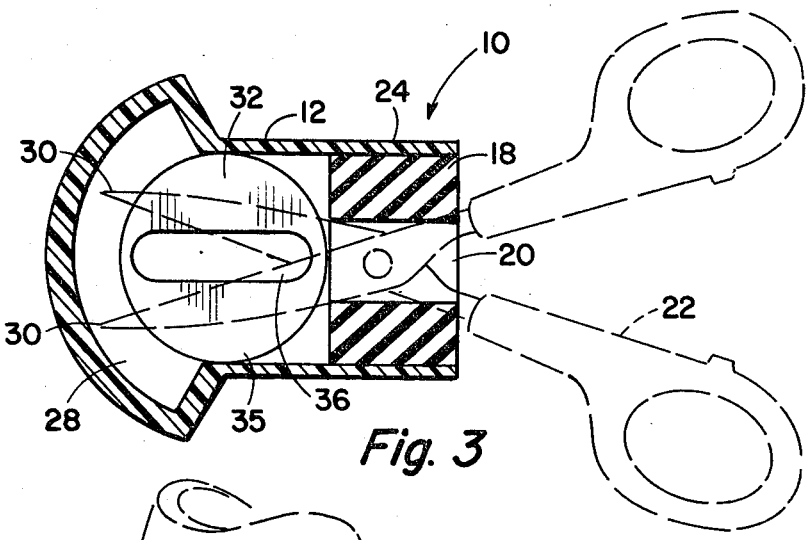
FIG. 3 is a plan cross-sectional view taken along section line 3—3 of FIG. 2.

The device 10 also includes a plurality of cylindrical attachments or tubes 32 (only one of which is shown) which can be of varying lengths so as to support the housing 12 at different predetermined distances above the head 26. The attachment 32 is inserted into the lower end of the main housing until the lower end 11 of the housing rests against a stop 34 which is formed as annular ridge on the outer surface of the tube. In one form of the invention, as shown in FIG. 4, the tube 32 is provided with a flat disc or top 35 which is mounted on or attached to the upper end of the tube 32 and which has a cut-out slot 36. Attachment 32 is also provided with a plurality of holes 38 around its lower open end 37 which facilitate the suction action of the vacuum source. Cut-out slot 36 lies underneath and parallel to the scissors 22, as best shown in FIG. 3.

Figure 2:
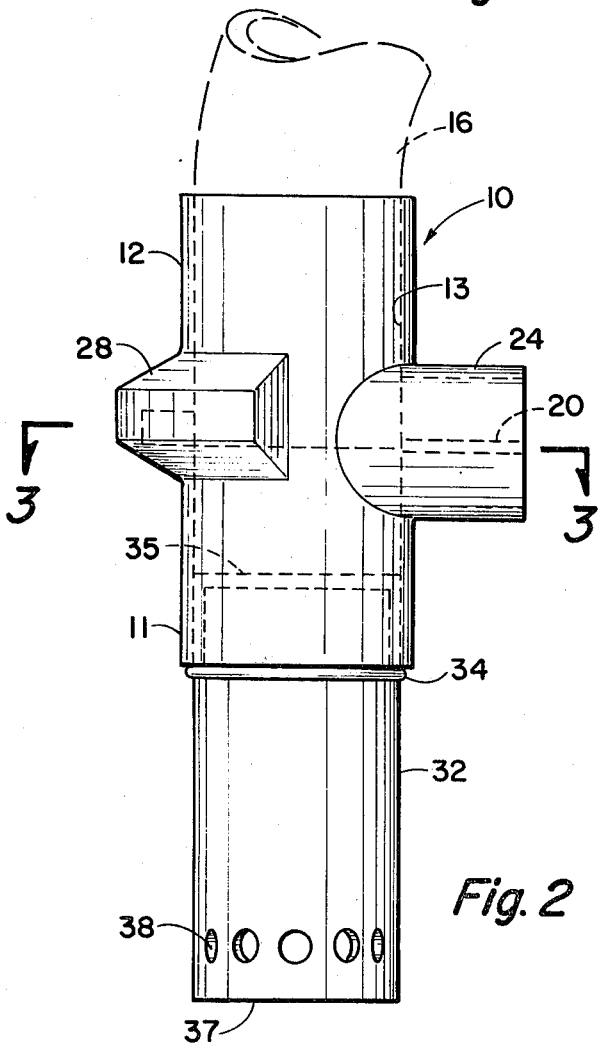
FIG. 2 is a front elevational view of the hair cutting device.

An alternate arrangement of the cut-out slot 36, provides for the cut-out slot to be an integral part of the housing 12. Although the element 35 (in FIG. 2) has been referred to as a disc mounted on the top of the tube 32, element 35 could be formed as a membrane molded into the main housing 12 with the slot 36 provided in its surface. Again alternatively, the disc 35, instead of being placed on the top of the tube 32, could be inserted through the lower end 11 of the housing 12 and could be glued or otherwise attached to the main passageway through the housing so as to occupy the position shown in FIG. 2. A tube (not shown) open at both ends could replace attachment 32 to provide varying hair length choices.

In order to operate device 10 of the present invention, an operator places the lower end 37 of the tube 32 against a person's head 26, as shown in FIG. 1. The vacuum source (not shown) is turned on and hair is drawn up through the open bottom end of attachment 32 into the main passageway 13. The operator then cuts the hair with the scissors 22. The device 10 is moved over the entire head until a uniform cut is achieved. By selecting a tube 32 of greater or lesser length, as compared to that shown in the drawing's, the hair can be cut to correspondingly greater or lesser lengths.

Whereas the present invention has been described in particular relation to the drawings attached hereto, it should be understood that other and further modifications, apart from those shown or suggested herein, may be made within the spirit and scope of this invention.

What is claimed is:

1. An improved hair cutting apparatus used in conjunction with a vacuum suction source comprising a hollow cylindrical main housing connectible at an upper end to a vacuum hose and having a lower end disposable at a predetermined fixed distance away from the head of a person whose hair is to be cut, a supporting means extending from one side of said main housing for securing a pair of scissors in a constant transversely oriented position, a stabilizing means extending from a side opposite said one side of said main housing for supporting the cutting tips of said pair of scissors, and a member having a slot therein mounted in said main housing beneath and parallel to said pair of scissors; and whereby placing the lower end of said main housing at said predetermined distance away from said head and activating said vacuum suction source draws a portion of hair into said main housing and through said slot to be cut by said pair of scissors.

2. An improved hair cutting apparatus as set forth in claim 1 wherein said supporting means comprises an oval shaped rubber scissor support being received in a complimentary support housing extending from said one side of said main housing and said scissor support having a lateral slot therein for receiving said pair of scissors.

3. An improved hair cutting apparatus as set forth in claim 1 wherein said stabilizing means comprises an annular scissor guide extending from the side opposite said one side whereby the cutting tips of said pair of scissors are received within said scissor guide to move freely therein.

4. An improved hair cutting apparatus as set forth in claim 1 and including a of tubular attachment having an upper end insertable into the lower end of said main housing and as lower end adapted to rest against said head for supporting said housing at said predetermined distance away from said head.

* * * * *